US005433087A

United States Patent [19]

Locatelli

[11] Patent Number: 5,433,087

[45] Date of Patent: Jul. 18, 1995

[54] HEAT EXCHANGER, PARTICULARLY FOR USE AS A RACK EVAPORATOR IN REFRIGERATORS OR FREEZERS

[75] Inventor: Gianbattista Locatelli, Lecco, Italy

[73] Assignee: Condenser Italiana S.p.A., Ispra, Italy

[21] Appl. No.: 181,491

[22] Filed: Jan. 14, 1994

[30] Foreign Application Priority Data

Jan. 25, 1993 [IT] Italy ..... MI93A0110

[51] Int. Cl.[6] ..... F25B 39/00

[52] U.S. Cl. ..... 62/520; 165/171

[58] Field of Search ..... 62/250, 520; 165/171

[56] References Cited

U.S. PATENT DOCUMENTS 2,334,284 11/1943 Philipp ..... 62/520
2,473,508 8/1945 Collins .
3,144,079 8/1964 Mack ..... 62/520 X

FOREIGN PATENT DOCUMENTS 2008733 6/1979 United Kingdom .
2145806 4/1985 United Kingdom .

*Primary Examiner*—John C. Fox
*Attorney, Agent, or Firm*—Guido Modiano; Albert Josif

[57] ABSTRACT

Heat exchanger, particularly for use as a rack evaporator in refrigerators or freezers, including a plurality of stacked shelves and comprising for each shelf: a coil, constituted by a tubular body extending along a path with bends alternated with straight and substantially mutually co-planar portions and by a supporting and/or heat-exchange enhancement structure constituted by metal rods welded to the coil and forming, above the coil, a supporting surface which is substantially parallel to the plane of arrangement of the coil. The coil has, for each shelf, at least one portion that is disconnected from the supporting and/or heat-exchange enhancement structure, and this portion lies substantially parallel to the longer straight portions of the coil and proximate to one side of the shelf. This portion disconnected from the supporting and/or heat-exchange enhancement structure is connected to a tubular portion that mutually connects the coils of two shelves which are not mutually co-planar.

4 Claims, 2 Drawing Sheets

HEAT EXCHANGER, PARTICULARLY FOR USE AS A RACK EVAPORATOR IN REFRIGERATORS OR FREEZERS

BACKGROUND OF THE INVENTION

The present invention relates to a heat exchanger, particularly for use as a rack evaporator in refrigerators or freezers.

Refrigerators are known which are constituted by a box-like structure inside which a plurality of mutually stacked and spaced shelves is arranged to support the goods to be preserved.

In order to achieve higher efficiency of the refrigeration circuit and to keep the temperature inside the refrigerator or freezer as uniform as possible, in some types of refrigerator each shelf is constituted by a coil evaporator formed by means of a tubular body extending along a path that forms bends alternated with straight and substantially mutually co-planar portions. A structure is furthermore associated with the coil of each shelf and may be constituted by rods welded to the coils or by a plate-like element which is seamed or rigidly connected (for example by welding or glueing or other known rigid coupling methods) to the associated coil and has the purpose of forming a supporting surface for the products to be arranged on the shelves and, at the same time, of increasing the heat exchange surface of the coil.

In many kinds of these evaporators, indeed termed rack evaporators, the coils of the various shelves are formed by means of one or more tubular bodies which are variously folded so as to form the straight portions and the bends of each coil and mutually connect the coils of the various shelves.

During the manufacture of the entire evaporator and/or during surface treatment and/or handling, transport and packaging, it is sometimes necessary to apply an axial torsion to some appropriate straight portions of the tubular body, and in particular to one or both of the outermost portions of the set of parallel co-planar tube portions that forms, together with the bends, the coil of the individual shelf (this set is hereafter simply termed "grid").

This possibility exists, and is sometimes used, in the tubular system of evaporators in which the supporting and/or heat-exchange enhancement surface is constituted by a plate which is seamed to the grid (rotation by axial torsion of the tube inside the seams), whereas in the evaporator, in which the supporting and/or heat-exchange enhancement surface is constituted by metal rods welded to the grid that constitutes the individual shelf, this possibility has never been available, since the rods have always been welded or otherwise rigidly coupled to all of the above mentioned tube portions: the required angle of axial torsion is in fact usually such that it does not allow to discharge the entire torsion onto the small portion of tube that has no welds to the rods and is in any case such as to cause unacceptable deformations on the rods and/or deformations/breakages of the tube portion affected by the rotation.

In some types of rack evaporator there is an additional branch which is arranged proximate to one side of the shelf, is orientated at right angles to tile longer straight portions of the coil, and is not affected by the supporting structure constituted by the rods. Although this solution at least partially solves the problem of torsion on the additional branch, it has the drawback that it greatly complicates the production of the evaporator, indeed due to the arrangement of the additional branch, and for this reason it can be adopted with some benefit only in the manufacture of evaporators having at the most two shelves formed with a single curved tube, thus forcing to mutually connect multiple pairs of shelves by welding.

SUMMARY OF THE INVENTION

The aim of the present invention is to solve the problems described above by providing a heat exchanger, particularly for use as a rack evaporator in refrigerators or freezers, in which it is possible to perform the desired torsion of the tube portion or portions of the various coils to obtain the stacked configuration of the various shelves without discharging stresses onto the rod structure rigidly associated with the coils.

Within the scope of this aim, an object of the invention is to provide a heat exchanger, particularly for use as a rack evaporator, that can be obtained with limited production times and/or costs with respect to the production times required by conventional rack evaporators, whether manufactured with multiple separate and subsequently assembled shelves or with multiple shelves obtained from a single continuous tube.

Another object of the invention is to provide a heat exchanger particularly for use as a rack evaporator which can have a lower defect rate and thus better general quality with respect to known evaporators.

With this aim, as well as these and other objects in view, which will become apparent hereinafter, there is provided, according to the present invention, a heat exchanger, particularly for use as a rack evaporator in refrigerators or freezers, of the type comprising a plurality of stacked shelves and comprising for each shelf: a coil, constituted by a tubular body extending along a path with bends alternated with straight and substantially mutually co-planar portions and by a supporting structure composed of metal rods welded to said coil and forming, above said coil, a supporting surface which is substantially parallel to the plane of arrangement of the coil, characterized in that said coil has, for each shelf, at least one portion disconnected from said supporting and/or heat-exchange enhancement structure, said at least one portion lying substantially parallel to the longer straight portions of the coil and proximate to one side of the shelf, said portion disconnected from the supporting structure being connected to a tubular portion that mutually connects the coils of two shelves which are not mutually co-planar.

BRIEF DESCRIPTION OF THE DRAWINGS

Further characteristics and advantages of the heat exchanger according to the present invention will become apparent from the following detailed description of two preferred but not exclusive embodiments thereof, illustrated only by way of non-limitative example in the accompanying drawings, wherein.

DESCRIPTION OF THE PREFERRED EMBODIMENTS

Figure 1:
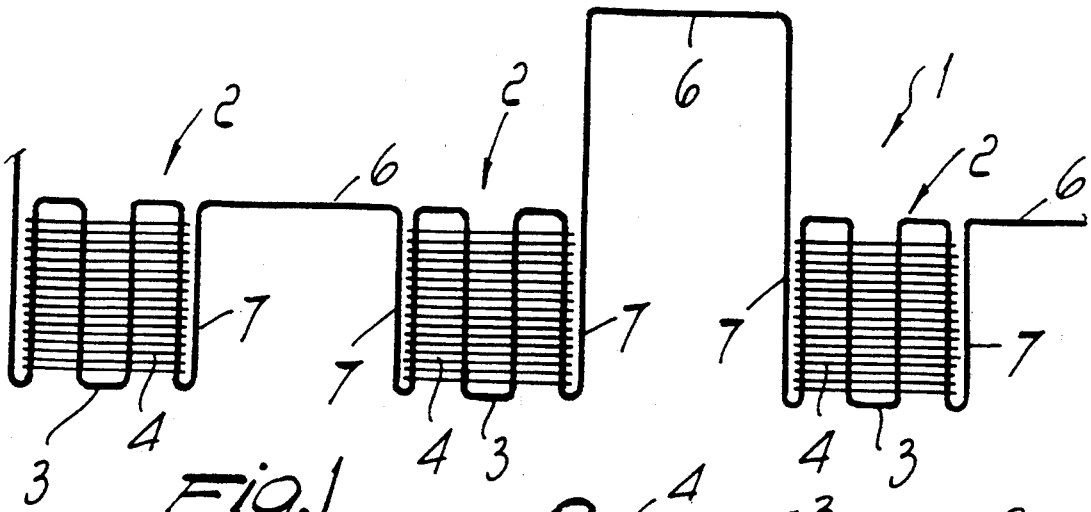
FIG. 1 is a view of the heat exchanger according to the invention in a first embodiment, laid out on a plane.
Figure 2:
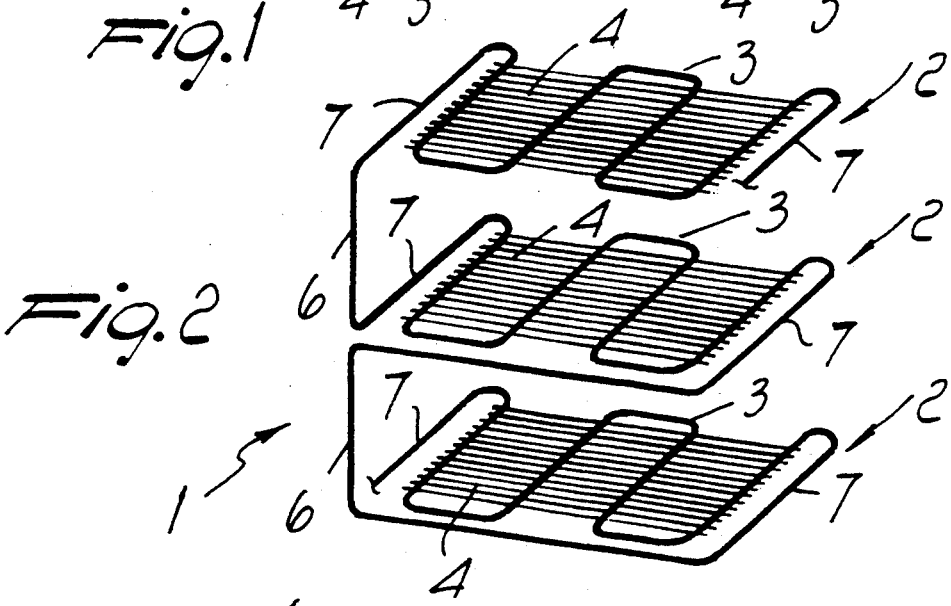
FIG. 2 is a perspective view of the heat exchanger of FIG. 1, in the arrangement with stacked shelves.
Figure 3:
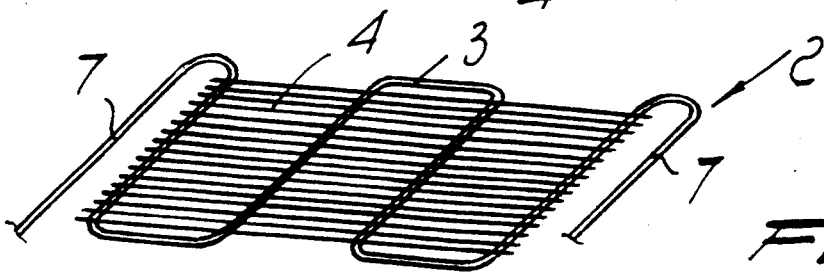
FIG. 3 is a perspective view of a shelf of the heat exchanger of the preceding figures.
Figure 4:
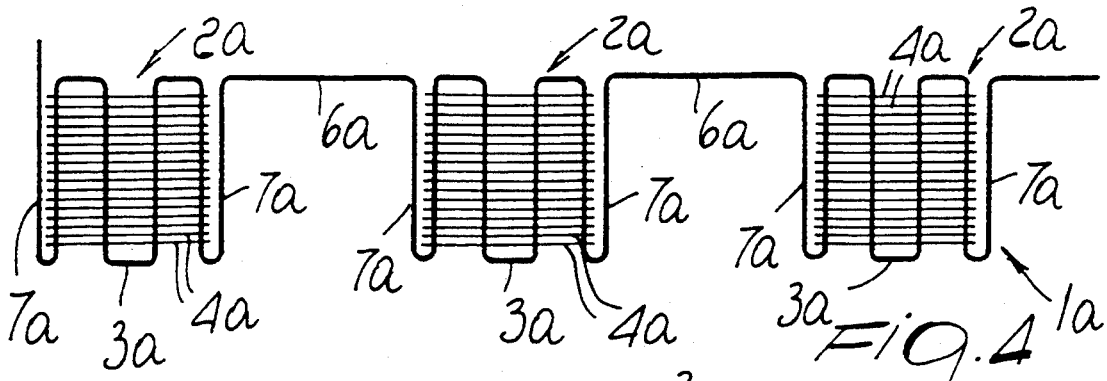
FIG. 4 is a view of the heat exchanger according to the invention in a second embodiment, laid out on a plane.
Figure 5:
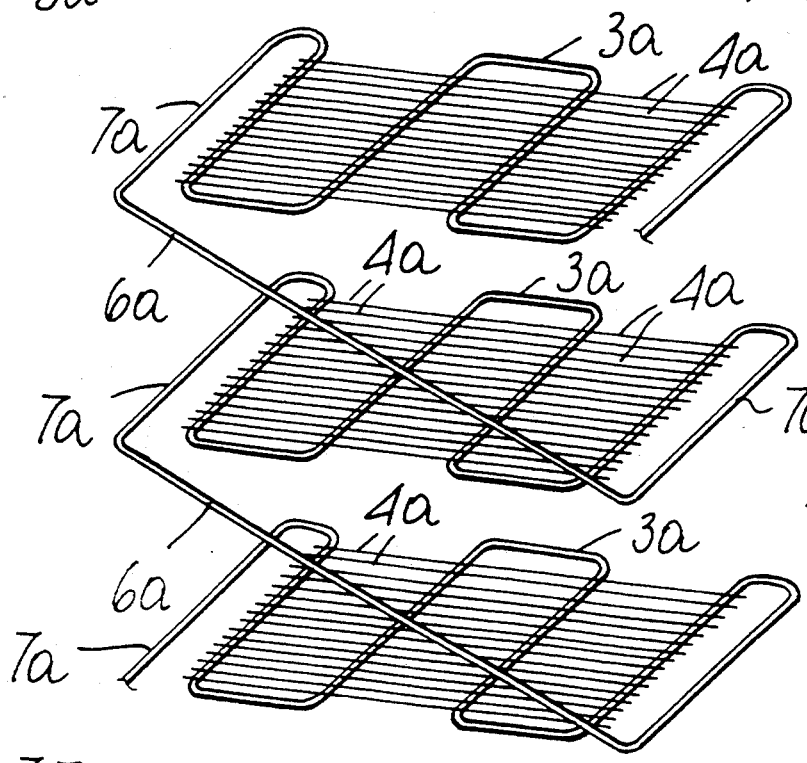
FIG. 5 is a perspective view of the heat exchanger of FIG. 4 in the arrangement with stacked shelves.

With reference to the above figures, the heat exchanger according to the present invention, generally designated by the reference numerals 1 and la in the two illustrated embodiments, is composed of a plurality of stacked shelves 2, 2*a* and comprises, for each shelf 2, 2*a*, a serpentine coil 3, 3*a* to which a supporting and/or heat-exchange enhancement structure 4, 4*a* is connected; said supporting and/or heat-exchange enhancement structure is constituted by a plurality of parallel rods that are associated by welding to the various branches of the coil 3, 3*a*, and forms a supporting surface which is parallel to the plane of arrangement of the associated coil.

More particularly, each coil, which forms one of the shelves of the exchanger, is preferably constituted by a single tubular body extending along a serpentine path with bends alternated with straight and mutually parallel and substantially co-planar portions. As clearly shown in FIGS. 1–5, the rods of the supporting structure 4, 4*a* extend transversely across the mutually parallel and coplanar portions of each serpentine coil 3, 3*a*.

Both in the first and in the second embodiments, the coil 3, 3*a* of each shelf is contained within an ideal rectangle, and the longer straight portions of the coil are arranged parallel to two opposite sides of this ideal rectangle.

The coils of the various shelves 2, 2*a* are mutually connected, i.e., placed in fluid communication by a tubular portion 6, 6*a*. The branch 7, 7*a* which is connected to the tubular portion 6, 6*a*, lies substantially parallel and proximate to one side of the shelf and is disconnected from the supporting structure 4, 4*a*.

More particularly, in both of the illustrated embodiments, there are two end branches 7, 7*a* that are disconnected from the supporting structure 4, 4*a* and are arranged at two mutually opposite and parallel sides of each shelf. The two branches 7, 7*a* that are disconnected from the supporting structure 4, 4*a* are furthermore parallel to the longer straight portions of the coil in a same shelf, and their distance from the closest longer straight portion is preferably less than the distance between the various longer straight portions of the coil that are rigidly connected to the supporting structure 4, 4*a*.

Figure 6:
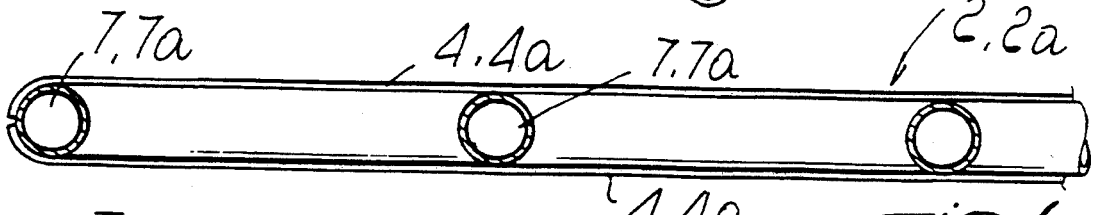
FIGS. 6 to 8 are enlarged sectional views of some examples of the connection of a supporting and/or heat-exchange enhancement structure made of rods to the tubular bodies of the coil.
Figure 7:
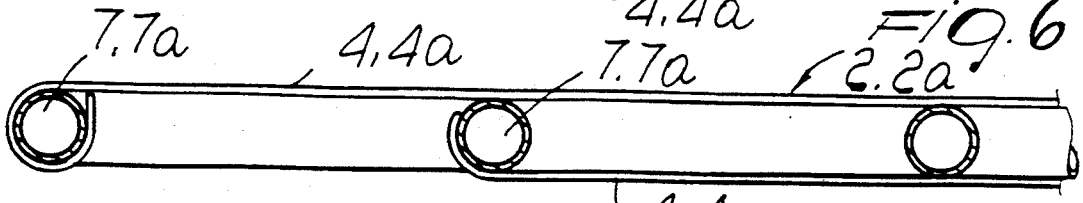
Figure 8:
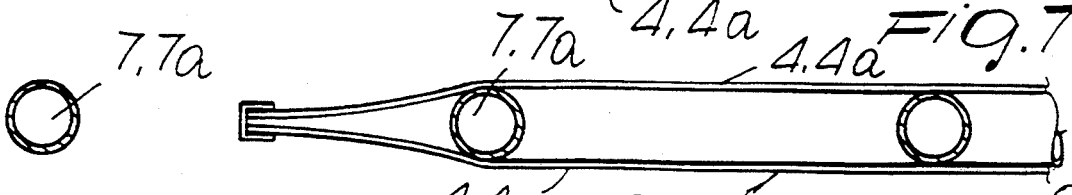

It should be noted that the expression "disconnected from the supporting structure" is to be understood as meaning that the branches 7, 7*a* are not rigidly connected to the supporting structure 4, 4*a*. This condition can be provided by the fact that the branches 7, 7*a* are not affected at all by the supporting structure 4, 4*a*, as shown in particular in FIGS. 1 to 5, but also by the fact that the rods composing the structure 4, 4*a* are simply curled or bent or kept in contact with the branches 7, 7*a*, as shown in detail in FIGS. 6 to 8, without thereby preventing torsional rotation of the branch 7, 7*a* with respect to these rods. In practice there is no rigid connection between the rods forming the supporting structure 4, 4*a* and the branches 7, 7*a*.

By virtue of this fact, it is possible to manufacture the heat exchanger according to the invention by bending a single tubular body, forming the various coils 3, 3*a* and the connecting portion 6, 6*a* on a same plane and subsequently applying, by welding or glueing, the supporting and/or heat-exchange enhancement structure 4, 4*a*. Then, by bending the portions 6, 6*a* with respect to the coils constituting the various shelves of the evaporator, the various coils are stacked. It should be noted that the bending of the portions 6, 6*a* that mutually connect the various coils can produce stresses that discharge onto the branches 7, 7*a* of the coils which are thus disconnected from the supporting structure 4, 4*a*. In this manner, the stresses that discharge onto the branches 7, 7*a* are not transmitted to the supporting structure 4, 4*a*, which preserves its planarity without problems, and the connection of the supporting structure to the coil is unaffected.

In practice it has been observed that the heat exchanger according to the invention fully achieves the intended aim, since the effects of the bending of the tubular portion that mutually connects the coils of the various shelves does not alter the shape and connection of the supporting structure applied to the coils in the various shelves.

A further advantage is that the bending operations to stack the various coils that form the shelves of the heat exchanger are considerably simplified.

Although the heat exchanger according to the invention has been conceived particularly for use as a rack evaporator, it can also be used as a simple heat exchanger, with the various coils arranged in planes having any orientation according to the requirements.

The heat exchanger thus conceived is susceptible to numerous modifications and variations, all of which are within the scope of the inventive concept; all the details may furthermore be replaced with other technically equivalent elements.

In practice, the materials employed, so long as they are compatible with the specific use, as well as the dimensions, may be any according to the requirements and the state of the art.

I claim:

1. A heat exchanger for use as a rack evaporator in refrigerators and freezers comprising;

a plurality of mutually interconnected serpentine coils (3, 3*a*), each serpentine coil (3, 3*a*) constituted by a single tubular body extending along a serpentine path, said serpentine path defining a plurality of mutually parallel straight coplanar portions;

a plurality of parallel rods extending across and rigidly connected to said mutually parallel straight coplanar portions of said plurality of serpentine coils (3, 3*a*) and defining together therewith a plurality of supporting structures (4, 4*a* );

two mutually parallel straight end branches (7, 7*a*) connected to each said serpentine coil (3, 3*a*) and lying coplanar thereto, said end branches ( 7, 7*a* ) being located at mutually opposite and parallel sides of each of said supporting structures (4, 4*a*), and;

tubular portions (6, 6*a* ) connected to said end branches (7, 7*a*), said tubular portions (6, 6*a*) placing one of said end branches (7, 7*a*) connected to one of said serpentine coils (3, 3*a*) in fluid communication with another of said end branches (7, 7*a*) connected to another one of said serpentine coils (3, 3*a*);

wherein said end branches (7, 7*a*) are movable, by bending, with respect to said plurality of parallel rods, and said tubular portions (6, 6*a*) are movable, by bending, with respect to said end branches (7, 7*a*), without thereby causing deformation of said supporting structures (4, 4*a*).

2. A heat exchanger according to claim 1, wherein said plurality of mutually interconnected serpentine coils (3, 3*a*) comprise three serpentine coils, and wherein said plurality of tubular portions (6, 6*a*) comprise two tubular portions (6, 6*a*) placing one of said end branches (7, 7*a*) connected to one of said three serpentine coils (3, 3*a*) in fluid communication with another of said end branches (7, 7*a*) connected to another one of said three serpentine coils (3, 3*a*).

3. A heat exchanger according to claim 2, wherein said plurality of supporting structures (4) are vertically superimposable, and wherein said tubular portions (6) are substantially axially aligned upon vertically superimposing said supporting structures (4).

4. A heat exchanger according to claim 2, wherein said plurality of supporting structures (4*a*) are vertically superimposable, and wherein said tubular portions (6*a*) are substantially parallel to each other upon vertically superimposing said supporting structures (4).

* * * * *